US008771023B2

(12) United States Patent
De Bruijn

(10) Patent No.: US 8,771,023 B2
(45) Date of Patent: Jul. 8, 2014

(54) LEAD FRAME ASSEMBLY FOR AN ELECTRICAL CONNECTOR

(75) Inventor: Jeroen De Bruijn, Loon Op Zand (NL)

(73) Assignee: FCI, Guyancourt (FR)

( * ) Notice: Subject to any disclaimer, the term of this patent is extended or adjusted under 35 U.S.C. 154(b) by 476 days.

(21) Appl. No.: 12/998,233

(22) PCT Filed: Sep. 30, 2008

(86) PCT No.: PCT/IB2008/055634

§ 371 (c)(1),
(2), (4) Date: Apr. 25, 2011

(87) PCT Pub. No.: WO2010/038110

PCT Pub. Date: Apr. 8, 2010

(65) Prior Publication Data

US 2011/0195607 A1 Aug. 11, 2011

(51) Int. Cl.
*H01R 13/514* (2006.01)

(52) U.S. Cl.
CPC ..... *H01R 13/514* (2013.01)
USPC ..... 439/701

(58) Field of Classification Search
USPC ..... 439/697.07, 701, 607.07, 607.05, 439/607.11
See application file for complete search history.

(56) References Cited

U.S. PATENT DOCUMENTS 5,702,258 A * 12/1997 Provencher et al. ..... 439/79
5,795,191 A 8/1998 Preputnick et al. ..... 439/608
5,860,816 A * 1/1999 Provencher et al. ..... 439/79
5,924,899 A * 7/1999 Paagman ..... 439/701
6,146,202 A * 11/2000 Ramey et al. ..... 439/607.1
6,267,604 B1 * 7/2001 Mickievicz et al. ..... 439/79
6,293,827 B1 * 9/2001 Stokoe ..... 439/607.07
6,299,483 B1 * 10/2001 Cohen et al. ..... 439/607.07
6,386,924 B2 * 5/2002 Long ..... 439/701
6,431,914 B1 * 8/2002 Billman ..... 439/607.07
6,527,587 B1 * 3/2003 Ortega et al. ..... 439/607.05
6,537,087 B2 * 3/2003 McNamara et al. ..... 439/108
6,551,140 B2 * 4/2003 Billman et al. ..... 439/607.07
6,554,647 B1 * 4/2003 Cohen et al. ..... 439/607.07
6,592,381 B2 * 7/2003 Cohen et al. ..... 439/80
6,602,095 B2 * 8/2003 Astbury et al. ..... 439/607.07
6,609,933 B2 * 8/2003 Yamasaki ..... 439/607.11
6,709,294 B1 * 3/2004 Cohen et al. ..... 439/607.07
6,776,649 B2 * 8/2004 Pape et al. ..... 439/485
6,786,771 B2 * 9/2004 Gailus ..... 439/607.01
6,827,611 B1 * 12/2004 Payne et al. ..... 439/607.05
6,890,214 B2 * 5/2005 Brown et al. ..... 439/607.39

(Continued)

FOREIGN PATENT DOCUMENTS

JP 11-329635 11/1999
WO WO-98/11633 A1 3/1998

*Primary Examiner* — Neil Abrams
(74) *Attorney, Agent, or Firm* — Harrington & Smith

(57) ABSTRACT

A lead frame assembly for an electrical connector is provided. The lead frame assembly includes a first lead, a second lead adjacent the first lead and a dielectric material. The leads have a first end, a second end and an intermediate portion between the first end and the second end. The leads are received within the dielectric material with the intermediate portions being substantially surrounded by the dielectric material. The dielectric material includes at least a first channel in the dielectric material arranged in-between the first and second leads. The first channel is defined by at least three sides and has a length extending in a direction substantially parallel to the intermediate portions of the first and second leads.

9 Claims, 8 Drawing Sheets

(56) References Cited

U.S. PATENT DOCUMENTS

| | | | | |
|---|---|---|---|---|
| 6,890,215 | B2 * | 5/2005 | Lang et al. | 439/607.35 |
| 6,932,649 | B1 * | 8/2005 | Rothermel et al. | 439/620.01 |
| 6,979,215 | B2 * | 12/2005 | Avery et al. | 439/248 |
| 6,997,755 | B2 * | 2/2006 | Varis | 439/701 |
| 7,195,519 | B1 * | 3/2007 | McAlonis et al. | 439/607.39 |
| 7,316,585 | B2 | 1/2008 | Smith et al. | 439/608 |
| 7,320,621 | B2 * | 1/2008 | Laurx et al. | 439/607.11 |
| 7,347,740 | B2 | 3/2008 | Minich | 439/736 |
| 7,381,092 | B2 * | 6/2008 | Nakada | 439/607.1 |
| 7,524,209 | B2 * | 4/2009 | Hull et al. | 439/607.01 |
| 7,585,186 | B2 * | 9/2009 | McAlonis et al. | 439/607.05 |
| 7,621,779 | B2 * | 11/2009 | Laurx et al. | 439/607.07 |
| 7,651,337 | B2 * | 1/2010 | McNamara | 439/65 |
| 7,789,676 | B2 * | 9/2010 | Morgan et al. | 439/79 |
| 7,798,852 | B2 * | 9/2010 | Laurx et al. | 439/607.08 |
| 7,819,697 | B2 * | 10/2010 | Glover et al. | 439/607.07 |
| 7,914,303 | B2 * | 3/2011 | Amleshi et al. | 439/82 |
| 7,927,143 | B2 * | 4/2011 | Helster et al. | 439/607.05 |
| 7,931,474 | B2 * | 4/2011 | Laurx et al. | 439/65 |
| 7,985,097 | B2 * | 7/2011 | Gulla | 439/607.39 |
| 8,123,532 | B2 * | 2/2012 | Davison et al. | 439/79 |
| 8,192,232 | B2 * | 6/2012 | Whiteman et al. | 439/620.01 |
| 8,231,415 | B2 * | 7/2012 | Johnescu et al. | 439/701 |
| 8,241,067 | B2 * | 8/2012 | Girard et al. | 439/620.21 |
| 8,262,412 | B1 * | 9/2012 | Minnick et al. | 439/607.01 |
| 8,337,249 | B2 * | 12/2012 | Lappoehn | 439/607.55 |
| 8,382,520 | B2 * | 2/2013 | Ritter | 439/607.05 |
| 8,382,522 | B2 * | 2/2013 | Glover et al. | 439/607.08 |
| 8,382,524 | B2 * | 2/2013 | Khilchenko et al. | 439/620.09 |
| 8,469,745 | B2 * | 6/2013 | Davis et al. | 439/607.07 |
| 8,506,330 | B2 * | 8/2013 | Mizukami et al. | 439/607.07 |
| 8,591,257 | B2 * | 11/2013 | Girard et al. | 439/607.07 |
| 8,616,919 | B2 * | 12/2013 | Stoner | 439/607.07 |
| 2004/0224559 | A1 * | 11/2004 | Nelson et al. | 439/608 |
| 2007/0021003 | A1 | 1/2007 | Laurx et al. | 439/608 |
| 2011/0159744 | A1 * | 6/2011 | Buck | 439/660 |
| 2011/0195607 | A1 * | 8/2011 | De Bruijn | 439/660 |
| 2012/0135641 | A1 * | 5/2012 | Okuyama et al. | 439/626 |

* cited by examiner

LEAD FRAME ASSEMBLY FOR AN ELECTRICAL CONNECTOR

TECHNICAL FIELD

The present invention relates to the field of electrical connectors, in particular to a lead frame assembly for an electrical connector.

BACKGROUND

In the field of electrical connectors it is generally known to provide a connector with a plurality of leads, e.g. for transmitting a plurality of signals. It has proven useful to provide such connectors in a generally modular form comprising a number of lead frame assemblies, in particular for board-to-board connectors and backplane connectors.

Connectors are known to provide losses in the signals to be transmitted. This is undesirable.

Further, in a connector comprising a plurality of leads cross talk may occur between signals on nearby leads. This cross talk should be reduced or even prevented, e.g. by providing a relatively large separation between the leads. However, this solution counteracts the ongoing desire to reduce the size of electrical devices and connectors. Another option is to provide volumes with a low dielectric constant, preferably air gaps, in-between the leads. This option, however, may tend to weaken the connector structure.

Also, connecting a connector comprising a plurality of leads to a device, in particular a substrate such as a circuit board, requires force. The force to be applied may depend on the number of leads, the mounting arrangement and/or on the sizes and/or tolerances of the parts to be connected. A connector should therefore be relative robust to withstand forces occurring during mounting, in particular for automated mounting where there is little or no control or feedback of the forces occurring. The demand for a robust connector tends to conflict with the trend of reducing the size of connectors.

Consequently, there is a desire for an improved connector which reduces one or more of the above problems.

SUMMARY

In a first aspect of the invention, a lead arrangement according to claim 1 is provided.

The first and second ends corresponds usually to the contact portions (press-fit contacts and male or female contacts) of the leads. The intermediate portion of the leads corresponds to the terminal portion extending between these contact portions. Usually, the intermediate portion extends over the major part of the terminal length. This intermediate portion is surrounded by a first dielectric material. In other words, the intermediate portion is fully embedded in a dielectric material, such as a plastic material.

A first channel, arranged in-between the intermediate portions of the first and second leads corresponds to the room or the volume which would be enclosed between the intermediate portions of the first and second leads and two virtual planes, each one of which located here and there with regard to the first and second leads and tangent to both first and second leads. In other words, the channel substantially completely makes up the volume in-between said two adjacent leads and is filled with a second dielectric medium, such as the air.

The intermediate portion of the leads being substantially surrounded by the dielectric material allows providing a substantially constant amount of dielectric material around the leads, which reduces impedance variations along the leads and therewith reduces losses of the signal, e.g. reflection losses. The leads are preferably arranged substantially parallel e.g. in a columnar fashion, for facilitating manufacture and use. The leads may constitute a differential signal pair.

The channel in the dielectric material allows providing an air gap in-between the first and second leads. This helps reducing cross talk between the first and second leads. The channel may advantageously extend along substantially the entire length of the intermediate portion of the first and/or second lead, reducing the possibility of cross talk substantially along the leads.

Advantageously, the portions of the dielectric material surrounding the first and second leads are interconnected by the dielectric material along the channel, rendering mechanical robustness to the assembly. This, in turn, assists preventing impedance variations for the leads due to changes in the relative positions of the leads and nearby dielectric material. Thus the electrical behaviour of the leads is improved. It also allows application of a force in a direction of the relative arrangement of the leads, e.g. along a column of leads, such as for mounting the assembly to a further object e.g. a circuit board.

The channel further allows reducing the amount of dielectric material in the assembly, reducing material costs. The channel may further assist cooling the leads, e.g. by allowing a coolant flow through it.

The electrical and mechanical behaviour provided by the improved lead frame assembly allow it to be relatively small.

The assembly may comprise three or more leads; this assembly allows transmission of signals with reduced cross talk between at least the second and third leads. The three leads may constitute a differential signal pair and a ground.

The assembly of claim 3 facilitates manufacturing of the channel. This also holds for the assembly of claim 4. Such an assembly may suitably be manufactured using insert molding.

Advantageously, the assembly has a side face and the channel is open towards the side face of the assembly. The channel may be open along its entire length, e.g. for providing a substantially constant cross sectional shape substantially perpendicular to the longitudinal direction of the channel. In such an embodiment, the channel may be defined by portions of the dielectric material surrounding the leads adjacent the channel(s) and a web portion of the dielectric material interconnecting the afore-mentioned portions of the dielectric material surrounding the leads.

The first and second sides may be different from each other and advantageously may substantially opposite each other, e.g. opposite side faces of the lead frame assembly. This facilitates manufacturing of the assembly and it further may provide a substantially symmetric arrangement with respect to a plane comprising the leads, providing a substantially symmetric response to a force applied to the assembly.

The assembly may be formed to have a certain resiliency, allowing it to withstand relatively high forces substantially without damage.

The assembly of claim 4 assists preventing bending or flexing of the assembly at the position of the channel. It further allows adapting the channel to other objects in the vicinity of the assembly, and thus the impedance of the first and/or second lead due to its/their dielectric environment. The first and second portions of the length of the channel(s) are advantageously different adjacent portions, wherein in the adjacent portion the channel is shaped substantially the same, possibly in mirror-fashion with respect to a main plane of the assembly, such that the impedance of the leads adjacent the channel is substantially constant around the transition first portion to second portion.

In case the channels are open towards different sides, in particular when the open sides are substantially opposite each other and towards the side faces of the lead frame assembly, the assembly is relatively robust against a force applied in the direction of the relative arrangement of the leads, e.g. along a column of leads. The portions of the channels which are open to a particular side may have different lengths.

Arranging the open sides towards different sides of the assembly allows a coolant flow through the assembly, without requiring additional openings through the assemblies, e.g. perpendicular through it. Such additional openings may cause impedance variations on the leads and/or form structural weak points in the assemblies.

The first and second portions of the lengths of the channels may extend for approximately the same fraction of the length of the channels, such that the transitions first portion-second portion of both channels are arranged substantially at a first position along the intermediate portion of the second lead, in-between the first and second channels. In this way, the amount of dielectric material on either side of the first position may be substantially equal and impedance variations along the lead may be substantially prevented. In addition, a force applied to the assembly may be distributed relatively evenly over the assembly, therewith increasing its resistance to such a force substantially without deformation.

The assembly also provides a plurality of openings for ventilation through the dielectric material without requiring through holes to the assembly and/or a plane comprising the leads, e.g. perpendicular there through.

An assembly having air gaps between the leads, improves the behaviour against cross talk between the different leads and reducing the amount of dielectric material required for the assembly. The leads being surrounded by dielectric material allows maintaining a substantially constant impedance for the leads adjacent the channels.

An aspect of the invention is a connector comprising one or more of the above-described lead frame assemblies. Such a connector provides an improved strength/volume ratio. It further provides air gaps in-between adjacent leads for reduced cross talk and allowing cooling of the leads.

The invention will hereafter be more fully explained with reference to the drawings showing different embodiments of the invention by way of example.

DETAILED DESCRIPTION OF EMBODIMENTS

Figure 1B:
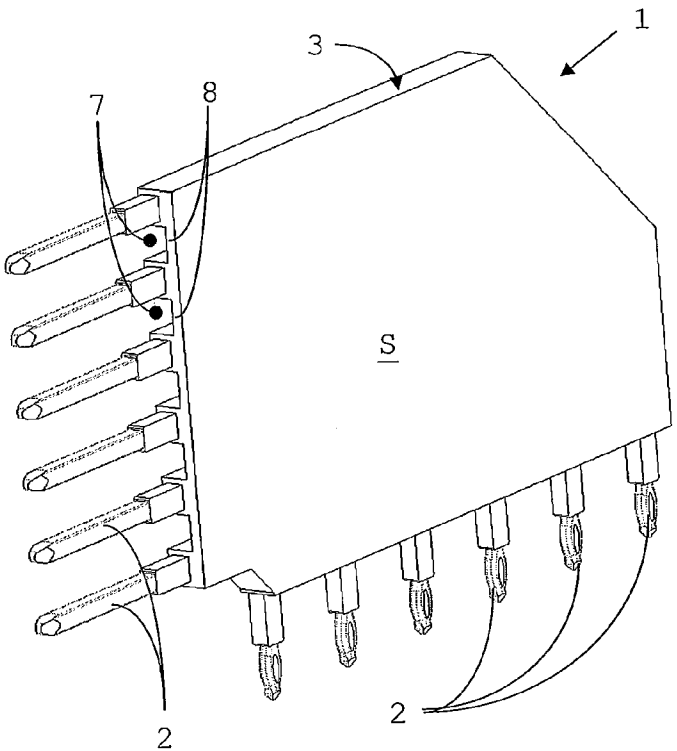
FIGS. 1A-1B are perspective views of a first embodiment of the invention.

In the following, like elements are indicated with like reference numerals. It should be noted that, for the sake of clarity of the Figures, not all such elements are indicated. It should further be noted that throughout the text, references to directions such as "top", "bottom", "side", "left", "right", "above" etc. refer to the orientations of the embodiments shown in the figures, unless explicitly stated otherwise.

Figure 1A:
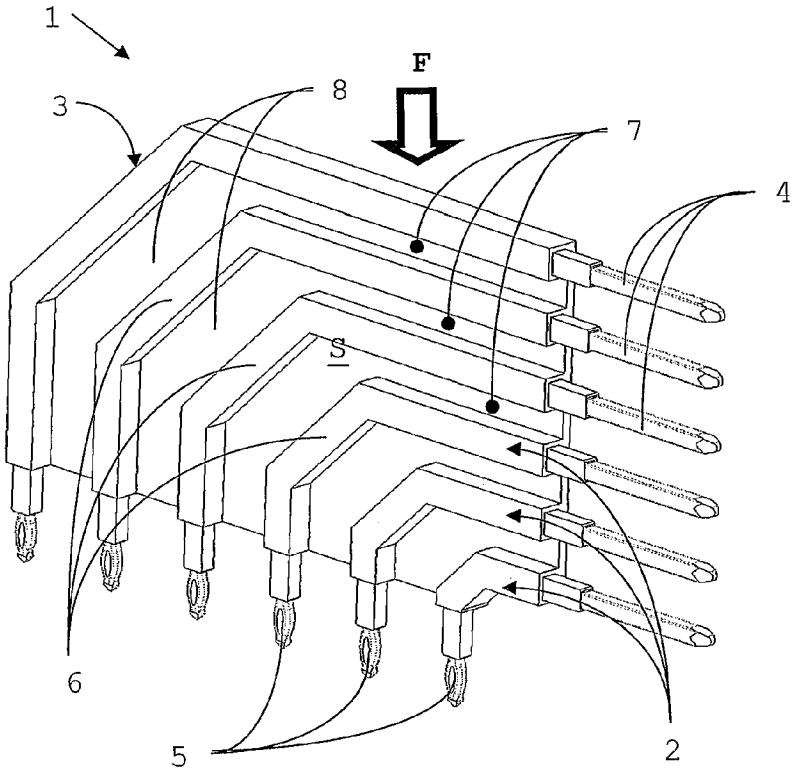

FIGS. 1A and 1B are two perspective views of different sides of a lead frame assembly 1, comprising a plurality of electrically conductive leads 2 (only three indicated), arranged in a housing or frame 3 made of dielectric material. The leads 2 are arranged substantially parallel to each other within the housing 3. The leads have a first end 4, a second end 5 and an intermediate portion 6 between the first end 4 and the second end 5. The leads 2 are arranged in a substantially planar fashion providing two main side faces S opposite each other.

The first ends 4 comprise a contact portion, here formed as male contact ends for connection with a female counterpart (not shown), the second ends 5 also comprise a contact portion, here formed as eye-of-the-needle press-fit contacts for contacting a printed circuit board (not shown). However, the contact ends 4, 5 may have any other suitable shape. The intermediate parts 6 are received in the housing 3 and are surrounded by its dielectric material such that the leads are fixed in position.

The frame or housing 3 comprises a plurality of channels 7 (only three indicated) formed in the dielectric material arranged in-between the intermediate portions 6 of the leads 2 and running substantially parallel thereto. As may be appreciated from FIGS. 1A-1B, each channel 7 is open towards one side of the assembly 1 and each is defined by three sides; the first and second sides are defined by the dielectric material of the housing portions surrounding the leads 2 adjacent the channel, and the third side is formed by a web portion 8 of the housing 3, which web portion 8 interconnects the afore-mentioned portions of the housing 3 surrounding the leads 2.

Thus, the housing 3 comprises substantially a continuous side wall formed by the housing portions surrounding the leads 2 and the web portions 8 in-between. It may be appreciated that the web portions 8 are arranged aside from leads 2, such that the channels 7 separate two adjacent leads, substantially completely making up the volume in-between two adjacent leads 2. The channels 7 thus separate adjacent leads 2 by an air gap in-between the adjacent leads 2, therewith reducing cross talk between two adjacent leads 2.

In the shown embodiment, the leads 2 are provided with a substantially uniformly shaped portion of dielectric material along the lengths of their intermediate portions 6 and also the web portions 8 are substantially uniformly shaped. Thus, the leads 2 have a substantially uniform impedance along their length.

The housing 3 maintains the relative position of the leads 2 and therewith prevents impedance variations of a lead on account of it experiencing a varying environment due to deformation of the assembly 1.

In particular, for mounting the embodiment shown in FIGS. 1A-1B to a further object such as a printed circuit board, a relatively high force (indicated with a bold arrow F in FIG. 1A) may be required to assure a proper press-fitting of the eye-of-the-needle contacts 5 possibly including their deformation. Due to the substantially continuous side wall of housing material in the direction of the force F, (the housing 3 of) the assembly 1 is adapted to withstand relatively high forces F without significant deformation. This facilitates mounting of the assembly 1 and it improves reliability of a finished product. This is in particular important for a connector comprising a plurality of assemblies 1, since then the number of leads 2 to be connected is multiplied, thus the total force to be applied for mounting is multiplied.

The lead frame assembly 1 may suitably be manufactured with insert-molding, such that the leads 2 are fixed to the housing 3 and the assembly substantially forms an integral whole.

When two such assemblies 1 are arranged side-by-side and in close contact, e.g. in a connector, the channels 7 allow a coolant flow, e.g. an air flow, along the longitudinal direction of the channels 7 and thus of the leads 2.

Further, when two such assemblies 1 are arranged side-by-side and in close contact, e.g. in a connector, one of their main side faces S comprising channels faces a main side face S which is flat. This provides additional rigidity since such assemblies can lean one against the other.

Figure 2B:
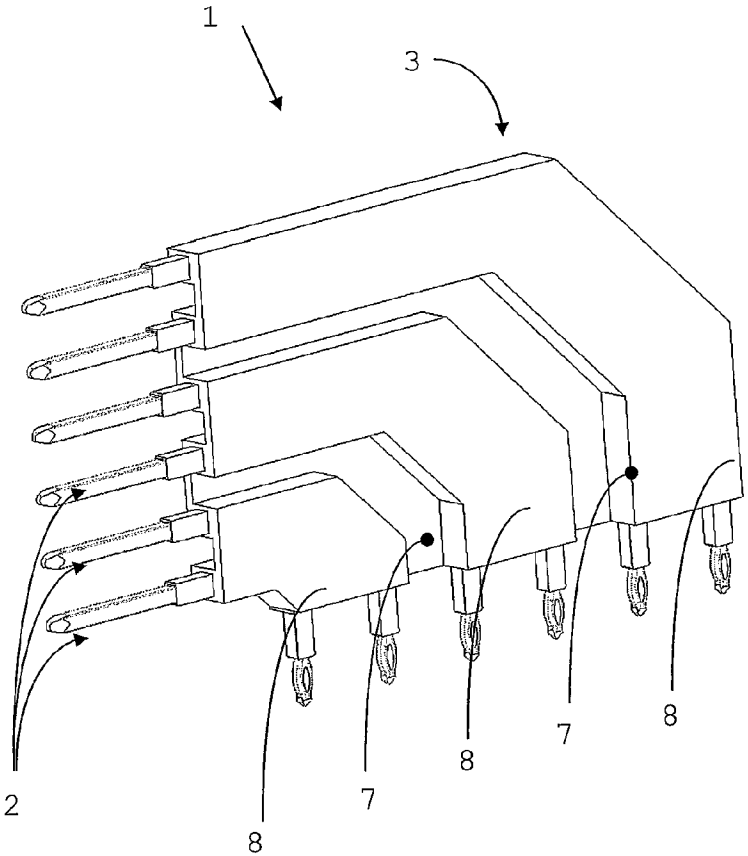
FIGS. 2A-2B are perspective views of a second embodiment of the invention.
Figure 2A:
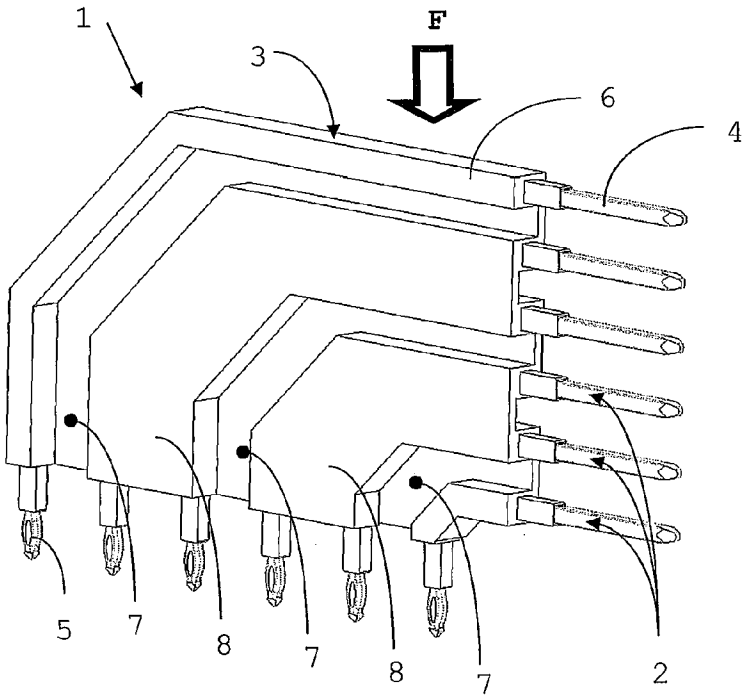

FIGS. 2A-2B show a second embodiment of the invention substantially similar to that of FIGS. 1A-1B. However in this embodiment adjacent channels 7 are open towards different sides of the assembly 1, here opposite sides. In other words, the webs of adjacent channels are arranged alternating on different sides of the channels 7 and of the assembly 1, here being towards the opposite main side faces of the assembly.

This arrangement of channels 7 and webs 8 provides the benefits of the embodiment of FIGS. 1A-1B. It further provides an increased resistance against the whole assembly 1 bending towards one side under the influence of an applied force F compared to the embodiment of FIGS. 1A-1B, due to all channels being open towards one side. The fortifying effect occurs in particular for a right angle connector, since the portions of the webs 8 arranged near the second ends 5 of the leads (cf. FIGS. 1A-1B) form substantially straight parallel walls resisting bending.

According to a variation one or more channels 7 may be closed on both sides of the assembly with web portions 8 opposite each other at substantially identical positions along the length of the channel 7 (or, equivalently, along the length of the adjacent leads 2). Such embodiment comprising substantially tubular channels or channel portions (not shown) provides the benefits of having air gaps in-between the leads 2 whereas it may provide an even larger resistance to bending under an applied force F, by virtue of having two webs 8 surrounding the channel 7.

Embodiments which substantially provide the constructional benefits of tubular channels and the electrical benefits discussed above, but which facilitate manufacturing, in particular by insert molding, are shown in FIGS. 3A-5B.

Figure 3B:
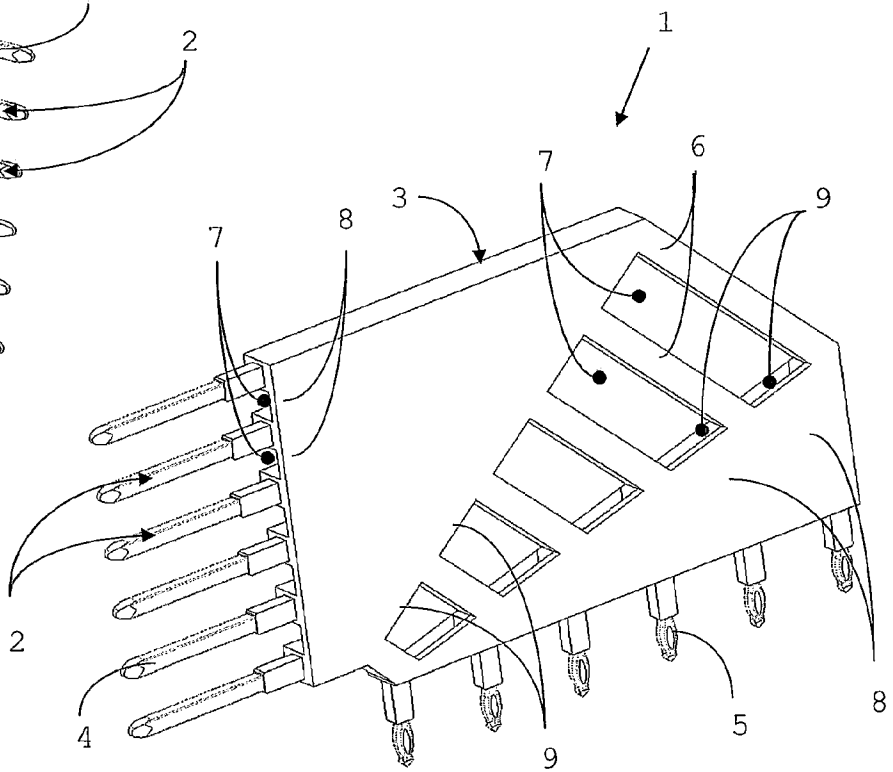
FIGS. 3A-3B are perspective views of a third embodiment of the invention.
Figure 3A:
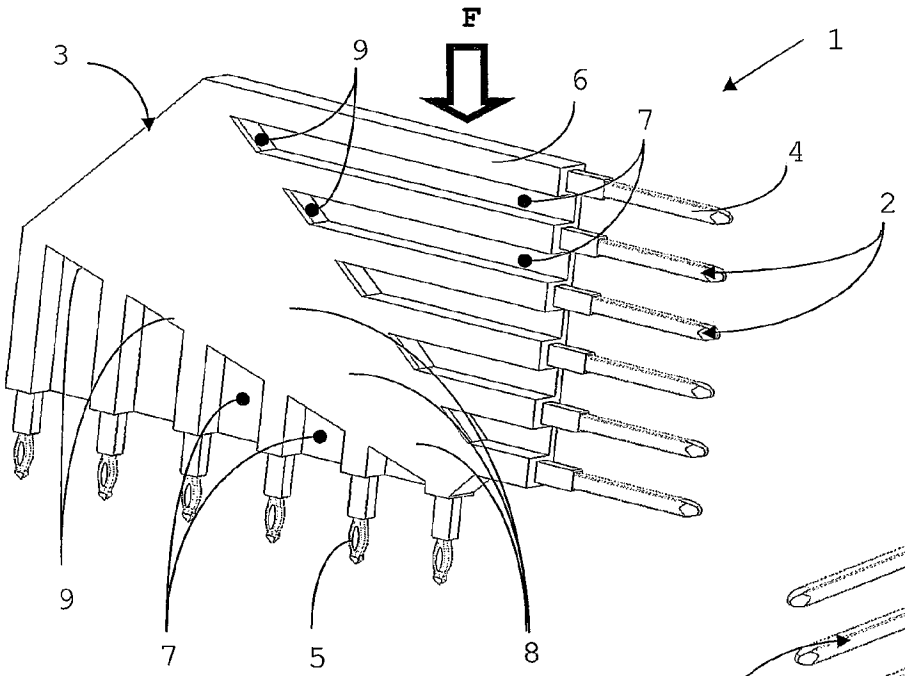

FIGS. 3A-3B show a third embodiment, in which each channel 7 along its longitudinal direction is open towards one side of the assembly 1 along a first portion of its length, then is open towards the opposite side of the assembly 1 along a second portion of its length and next is open again towards the first side of the assembly 1. In other words, along the longitudinal direction of the channel 7, the web portions 8 are arranged alternating on different sides of the channel 7 and of the assembly 1, the different sides here being the opposite side faces S of the assembly 1.

In this embodiment the web portions 8 are arranged on different sides of the channels 7 and are arranged such that at each position along the longitudinal direction of each channel 7, and of the leads 2 adjacent that channel 7, substantially a single web 8 is provided, i.e. substantially without overlapping web portions 8 and without portions having no web 8 on any side. Thus, the amount of dielectric material around the leads 2 under consideration and therewith the impedance of those leads 2 is substantially constant along the length of the leads 2.

The end positions of the individual web portions 8, i.e. the position in longitudinal direction along the leads 2 and channels 7 where the web portions 8 "change sides" are indicated with reference numeral 9 in the Figs. It will be seen in the Figs. that in the shown embodiments the end positions 9 are arranged such that the open portions of adjacent channels substantially correspond with each other, taken in the longitudinal directions of the channels. In FIGS. 3A-3B end positions 9 are arranged at approximately one-third and two-thirds the length of the channels 7 and of the intermediate portions 6 of the leads 2.

Figure 4B:
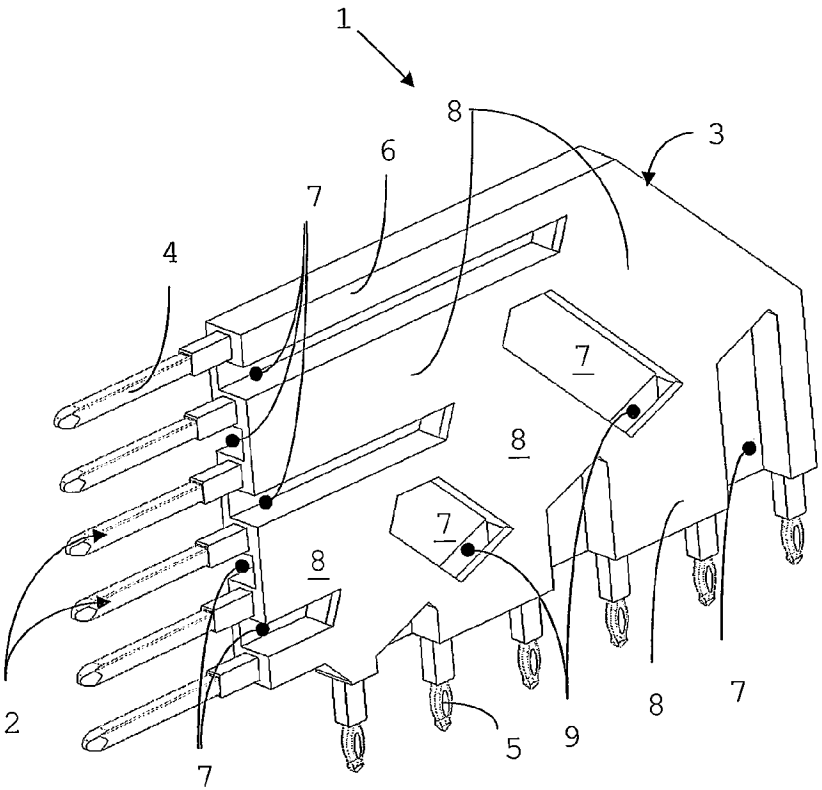
FIGS. 4A-4B are perspective views of a fourth embodiment of the invention.
Figure 4A:
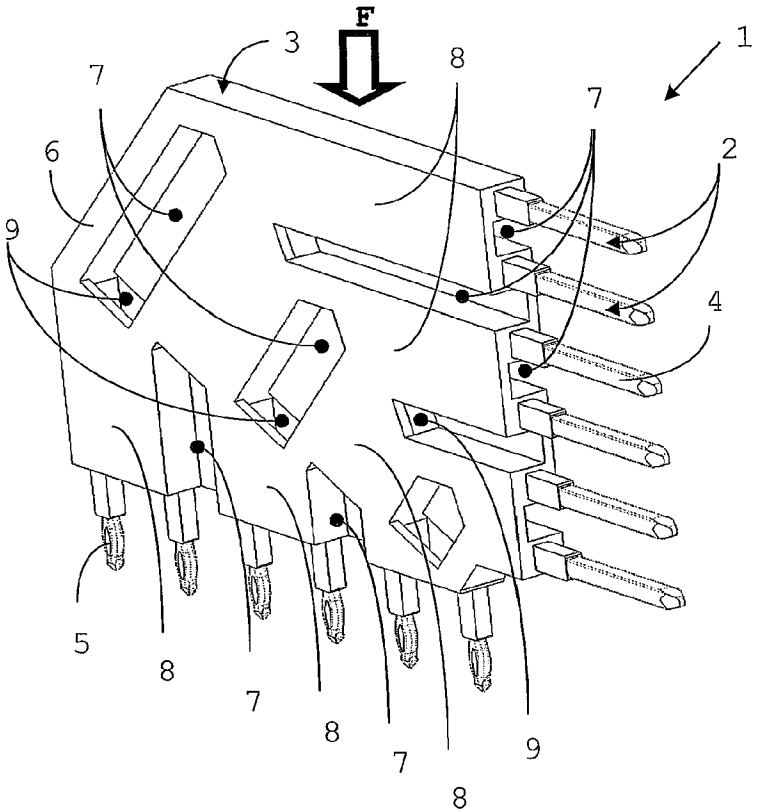

FIGS. 4A-4B show a fourth embodiment of an assembly 1, in which each channel 7 along its longitudinal direction is open towards one side of the assembly 1 along a first portion of its length, then is open towards the opposite side of the assembly 1 along a second portion of its length and next is open again towards the first side of the assembly 1. In addition, adjacent channels 7 are open towards different sides of the assembly 1, here opposite sides. In other words, the webs 8 of adjacent channels are arranged alternating on different sides of the channels 7 and of the assembly 1, here being opposite sides. The end positions 9 of the webs 8 of adjacent channels 7 are arranged at corresponding positions at approximately one-third and two-thirds of the length of the respective channels 7.

The embodiment of FIGS. 4A-4B combines the aspects of the embodiments of FIGS. 2A-2B and of FIGS. 3A-3B. The assembly is thus relatively resistant against an externally applied force F. It further substantially reduces cross talk between adjacent leads 2. It also provides a substantially continuous impedance of the leads 2.

Figure 5B:
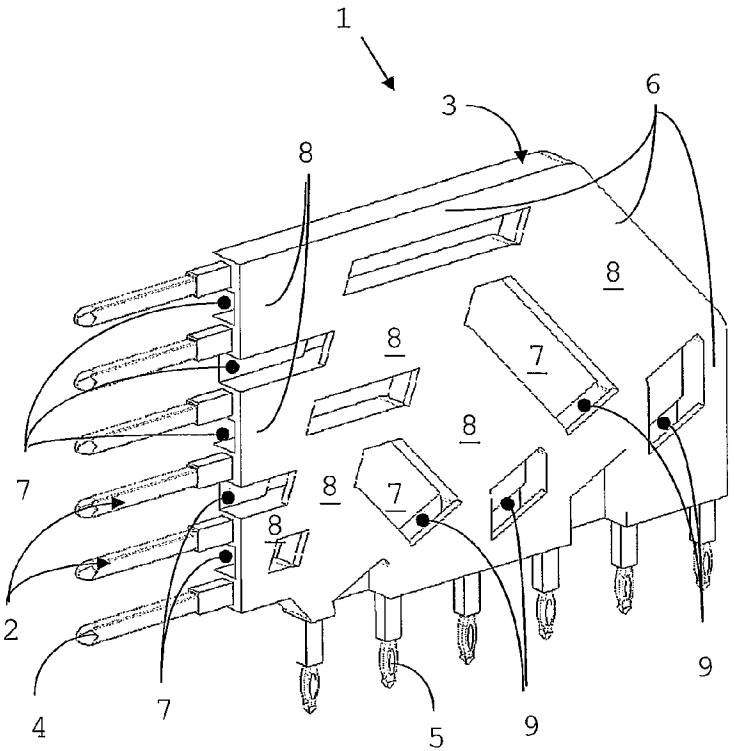
FIGS. 5A-5B are perspective views of a fifth embodiment of the invention.
Figure 5A:
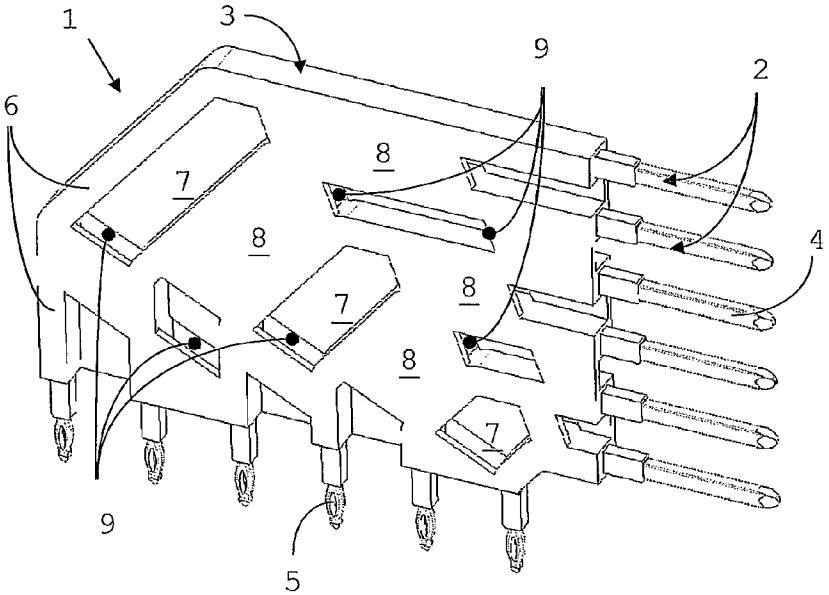

FIGS. 5A-5B show a further embodiment which may be seen as a variant of the embodiment of FIGS. 4A-4B. In this embodiment, each channel 7 is alternately open towards a first side of the assembly 1 and a second side of the assembly, such that each channel 7 is open towards a first side of the assembly 1 along three portions of its length and it is open towards a second side of the assembly 1 along two other portions of its length. Adjacent channels 7 are open towards substantially opposite sides of the assembly 1. The end positions 9 of the webs 8 of adjacent channels 7 are arranged at substantially corresponding positions along the longitudinal directions of the respective channels 7. In other words, in this embodiment each channel 7 may be seen to comprise along its length five consecutive portions which are open towards different, alternating sides of the assembly 1, the web portions 8 being arranged at different, alternating, sides of the channels 7.

Figure 6A:
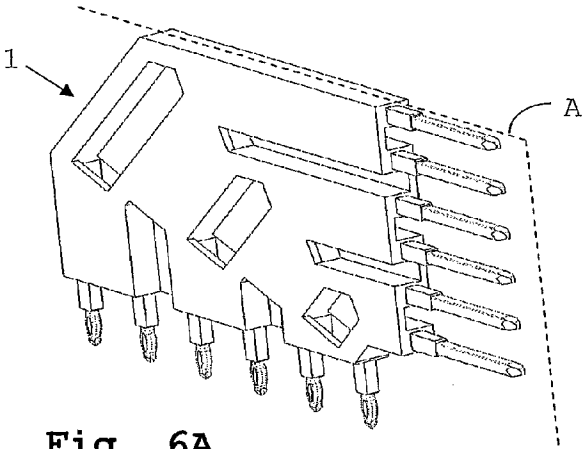
FIGS. 6A-6D show the embodiment of FIGS. 4A-4B (FIGS. 6A-6B) and a substantially identical but inverted embodiment (FIGS. 6C-6D).
Figure 6B:
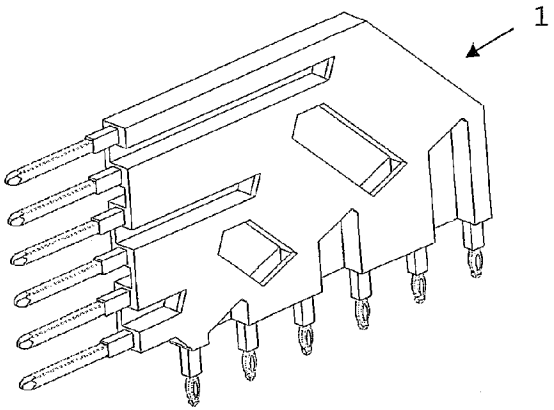
Figure 6C:
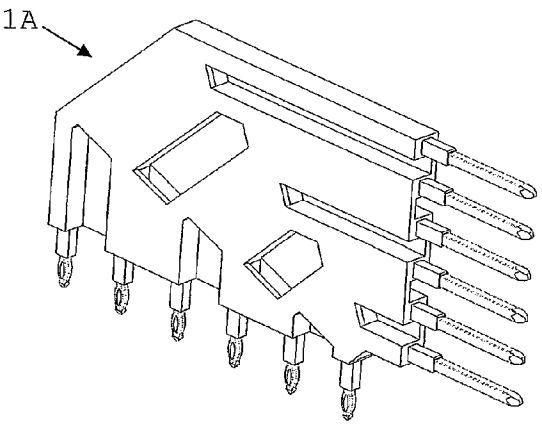
Figure 6D:
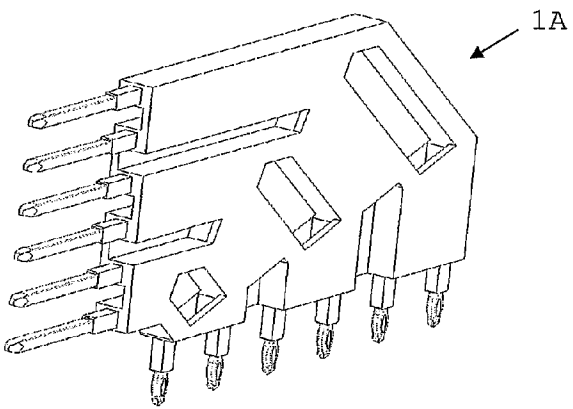

FIGS. 6A-6B show two side views of the assembly 1 of FIGS. 4A-4B, and FIGS. 6C-6D show a substantially identical assembly 1A, which is however a mirror image with respect to a main plane A of the assembly 1 (indicated in FIG. 6A). When these assemblies 1,1A of FIGS. 6A and 6C or FIGS. 6B and 6D respectively are placed in side-by-side relationship and in close contact such as they may be in a connector, the web portions 8 of each assembly 1,1A will be in close contact whereas the open sides of the channels 7 of the assemblies 1,1A will face each other. Such arrangement allows a coolant flow, e.g. an air flow through the channels 7 of the adjacent assemblies 1,1A. An arrangement of a plurality of adjacent alternating mirror image assemblies 1 and 1A thus allows a coolant flow effectively through the entire arrangement, without requiring openings perpendicular through the assemblies 1,1A, which might provide impedance variations on the leads and/or structural weak points in the assemblies.

FIGS. 7A-7D show an exemplary connector 10 comprising a plurality of lead frame assemblies 1 mounted in a housing 11 substantially in parallel adjacent each other with a small separation which is optional. Here, connector 10 is a board connector and the housing 11 is in the form of a header.

Figure 7B:
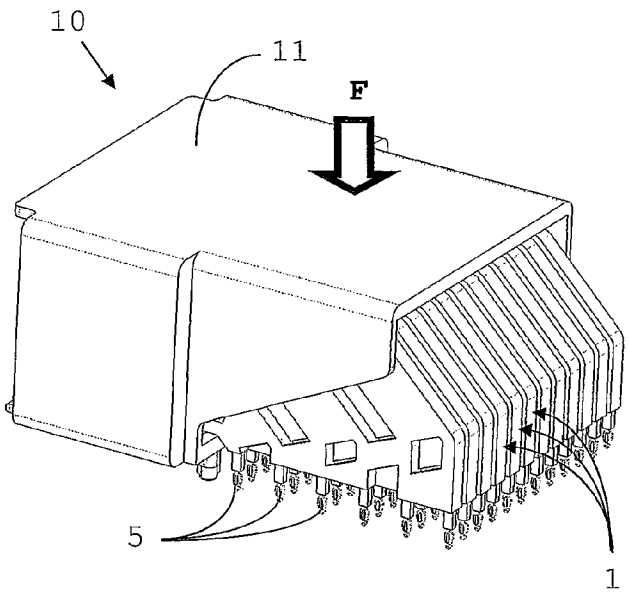
FIGS. 7A-7D are perspective views of an embodiment of a connector comprising a plurality of lead frame assemblies.
Figure 7A:
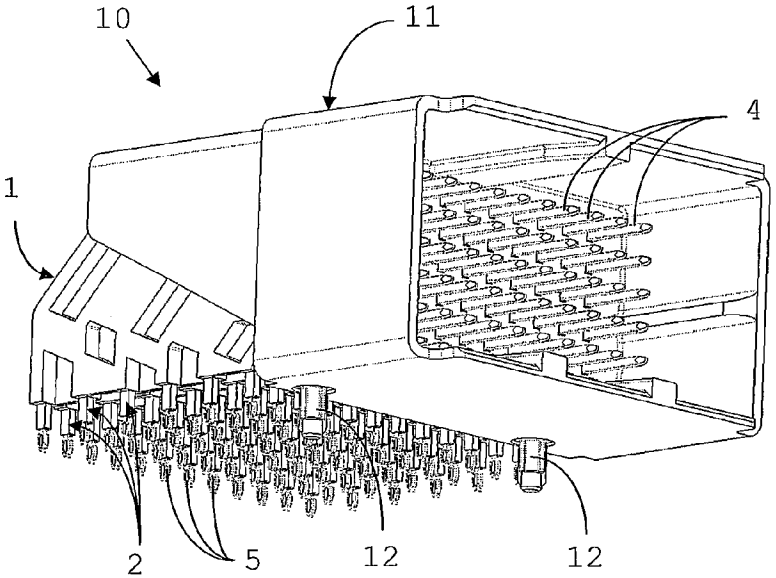
Figure 7D:
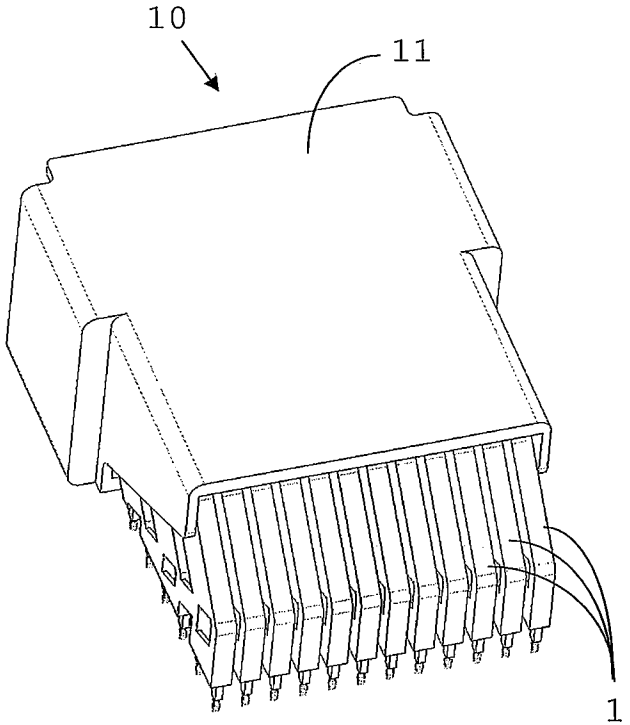
Figure 7C:
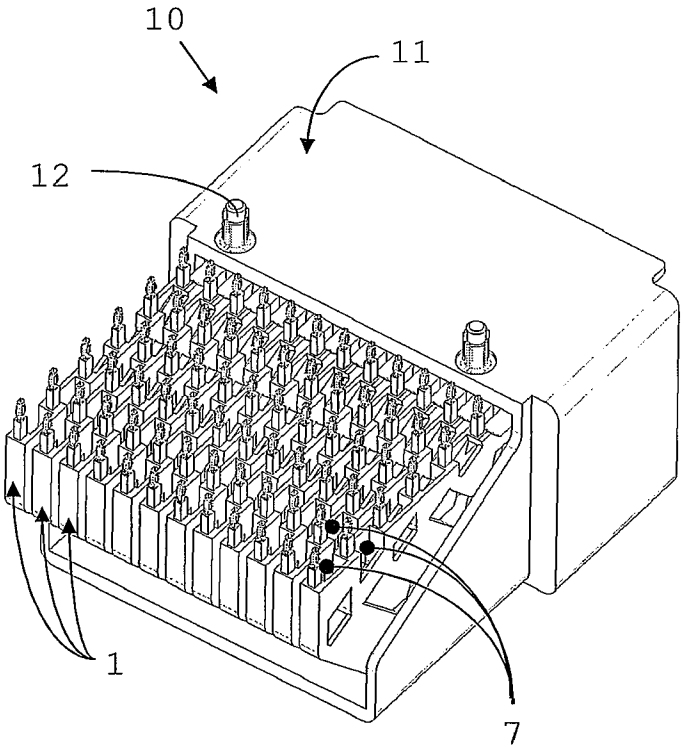

The housing 11 comprises means for attaching the connector 10 to a further object in the form of mounting legs 12 for mounting the connector 10 to a printed circuit board (not shown). The legs 12 protrude in a direction substantially parallel to the second ends 5 of the leads 2 of the assemblies 1. In the shown connector 10, the lead frame assemblies 1 are as shown in more detail in FIGS. 5A-5B, but any lead frame assembly falling within the scope of the appended claims may be suitably employed. In FIG. 7C the arrangement of the channels 7 of the assemblies 1 is visible.

The connector 10 may be press-mounted onto a suitable printed circuit board by applying a pressure F on the housing 11 and therewith on the lead frame assemblies 1. The eye-of-the-needle contacts 5 may make press fit contact with contacts of the board. The contacts may be soldered as well.

In the shown embodiment, the first contact ends 4 of the leads 2 are arranged substantially in vertical columns, by virtue of their arrangement within each assembly, and in horizontal rows, by virtue of the assemblies being substantially identical. The second contact ends 5 are similarly arranged in columns and rows and the leads 2 and channels 7 in adjacent assemblies 1 are arranged substantially parallel to each other along their lengths.

Besides providing signal paths with reduced cross talk between adjacent leads, the connector 10 allows an air flow through each assembly 1 for cooling.

The invention is not restricted to the above described embodiments which can be varied in a number of ways within the scope of the claims. For instance, the number of leads, channels and/or open portions of channels in an assembly may be chosen different.

Further, adjacent sets of channels, e.g. two adjacent channels may have one or more portions which are open towards one side of the assembly, and an adjacent set of adjacent channels, e.g. two further channels, may have substantially corresponding portions which are open towards another side of the assembly.

It should be noted that channels need not be present in-between each pair of mutually adjacent leads within a lead frame assembly.

Also, the shape of a channel, in particular the cross-sectional shape substantially perpendicular to its longitudinal direction, may vary throughout the length of the channel. The cross sectional shape may advantageously be formed for tailoring the amount of dielectric material surrounding one or more leads adjacent the channel for tailoring the impedance of those leads.

One or more portions of the channels may comprise or be filled with a material with a different dielectric constant. This allows adapting the impedance of at least the leads adjacent the channel.

Whereas in the shown embodiments, the lead frame assemblies are formed as a substantially right-angle connector, any other angular arrangement, e.g. substantially 45 degrees or 0 degrees (straight connector, such as a mezzanine connector), is equally conceivable.

Further, the dielectric material may surround the leads on at least three sides or on all four sides for leads having a substantially rectangular cross section. For leads having a substantially rounded cross section the dielectric material may surround the leads for about 270 degrees of rotation or more about the leads. In such a case a top or bottom wall of the channels may be defined by the side of a lead adjacent the channel.

The housing of a connector 10 may have a different form, corresponding to a different intended use for the connector.

A connector may comprise a mixture of different (types of) lead arrangements, possibly

- a combination of one or more known lead frame assemblies and one or more lead frame assemblies according to the invention, or
- a combination of one or more lead frame assemblies and one or more lead arrangement according to the invention.

Elements and/or aspects discussed with respect to one embodiment may be suitably combined with elements and/or aspect of different embodiments within the scope of the appended claims.

The invention claimed is:

1. Lead arrangement for a connector, comprising:

a first lead and a second lead adjacent the first lead fully positioned in the same plane as the first lead, the leads having a first end, a second end and an intermediate portion substantially surrounded, between the first end and the second end, by a first dielectric material;

wherein a first open channel is arranged in-between the intermediate portions of the first and second leads, the first channel being defined by a web of the first dielectric material between the first and second leads and surfaces of the first dielectric material substantially surrounding the intermediate portions between the first end and the second end of each lead and extending substantially over a length from the first end to the second end of each lead and substantially completely making up the volume in-between said two adjacent leads;

wherein said channel is filled with a second dielectric medium; and further comprising a frame made of dielectric material, wherein the frame comprises at least said first channel arranged in-between the intermediate portions of the first and second leads; and wherein at least the first channel is open towards a first side of the assembly along at least a first portion of the length of the channel and is open towards a second side of the assembly along at least a second portion of the length of the channel.

2. Lead frame assembly according to claim 1, wherein at least the first channel is defined by three sides and is open towards a first side of the assembly along at least a first portion of the length of the first channel.

3. Lead frame assembly according to claim 1, wherein the first channel is open towards a first side of the assembly along at least a first portion of the length of the first channel and is open towards a second side of the assembly along at least a second portion of the length of the first channel, and wherein a second channel between the intermediate portions of the first or second lead and a third lead is open towards the second side of the assembly along at least a first portion of the length of the second channel and is open towards the first side of the assembly along at least a second portion of the length of the second channel.

4. Lead frame assembly according to claim 3, wherein the first portion of the length of the first channel substantially corresponds with the first portion of the length of the second channel, taken in the direction of the channels.

5. Lead frame assembly according to claim 3, wherein the first channel is open towards a first side of the assembly along a plurality of portions of the length of the first channel and is open towards a second side of the assembly along a plurality of portions of the length of the first channel and wherein the second channel is open towards the second side of the assembly along a plurality of portions of the length of the second channel and is open towards the first side of the assembly, along a plurality of portions of the length of the second channel.

6. Lead frame assembly according to claim 5, wherein the portions of the length of the first channel substantially correspond with the portions of the length of the second channel, taken in the direction of the channels.

7. Lead frame assembly for an electrical connector, comprising a first lead, a second lead and a third lead, and a frame made of a dielectric material, the leads having a first end, a second end and an intermediate portion between the first end and the second end, wherein the leads are substantially surrounded by the dielectric material, over the whole length of their intermediate portions, wherein the frame comprises at least a first channel and a second channel in the dielectric material, wherein the first channel is arranged in-between the intermediate portions of the first and second leads, separating the first and second leads by an air gap, and the second channel is arranged in-between the intermediate portions of the second and third leads, separating the second and third leads by an air gap, the first and second channels being defined by at least three sides and having lengths extending substantially from the first end to the second end of each of the leads in directions substantially parallel to the intermediate portions of the first and second leads and the second and third leads, respectively, wherein the first channel is open towards a first side of the assembly along at least a first portion of the length of the first channel and is open towards a second side of the assembly along at least a second portion of the length of the first channel, and wherein the second channel is open towards the second side of the assembly along at least a first portion of the length of the second channel and is open towards the first side of the assembly along at least a second portion of the length of the second channel, and wherein said channels substantially completely make up the volume in-between said first, second and third adjacent leads.

8. Lead frame assembly for an electrical connector, comprising a first lead, a second lead and a third lead, and a frame made of a dielectric material, the leads having a first end, a second end and an intermediate portion between the first end and the second end, wherein the leads are substantially surrounded by the dielectric material, over the whole length of their intermediate portions, wherein the frame comprises at least a first channel and a second channel in the dielectric material, wherein the first channel is arranged in-between the intermediate portion of the first and second leads, separating the first and second leads by an air gap, and the second channel is arranged in-between the intermediate portion of the second and third leads, separating the second and third leads by an air gap, the first and second channels being defined by at least three sides and having a length extending in a direction substantially parallel to the intermediate portions of the first and second leads and the second and third leads, respectively, wherein said channels substantially completely make up the volume in-between said first, second and third adjacent leads wherein the first channel is open towards a first side of the assembly along a plurality of portions of the length of the first channel and is open towards a second side of the assembly along a plurality of portions of the length of the first channel and wherein the second channel is open towards the second side of the assembly along a plurality of portions of the length of the second channel and is open towards the first side of the assembly, along a plurality of portions of the length of the second channel, wherein the portions of the length of the first channel substantially correspond with the portions of the length of the second channel, taken in the direction of the channels.

9. Connector assembly comprising one or more lead frame assemblies according to claim 1.

* * * * *